United States Patent [19]

Maier

[11] 4,128,119

[45] Dec. 5, 1978

[54] APPARATUS FOR PROCESSING WORKPIECES IN THE FORM OF SHORT-LENGTH ELONGATE TIMBER WASTE INTO USABLE TIMBER

[75] Inventor: Fred Maier, Port Washington, N.Y.

[73] Assignee: Festo-Maschinenfabrik Gottlieb Stoll, Esslingen, Fed. Rep. of Germany

[21] Appl. No.: 698,685

[22] Filed: Jun. 22, 1976

[51] Int. Cl.[2] ..... B27F 1/08

[52] U.S. Cl. ..... 144/317; 83/409.1; 83/212; 83/158; 83/372; 90/18; 90/21 R; 118/242; 118/243; 156/258; 156/304; 156/578; 144/3 R; 144/85; 144/90 R; 144/314 B; 144/323; 144/326 R

[58] Field of Search ..... 144/1 R, 2 R, 3 R, 85, 144/89, 90 R, 90 A, 91, 198, 199, 200, 219, 314, 314 B, 315 R, 317, 326 R, 323; 83/437, 158, 409, 212, 414, 372; 156/258, 517, 304, 578; 118/242, 243, 263, 241; 90/18, 21 R, 11 B, DIG. 26; 198/339

[56] References Cited

U.S. PATENT DOCUMENTS

| | | | |
|---|---|---|---|
| 655,126 | 7/1900 | Stillwell | 144/234 |
| 1,339,467 | 5/1920 | McConnell | 118/243 |
| 3,179,135 | 4/1965 | Windsor | 144/91 X |
| 3,841,462 | 10/1974 | Schmidt | 198/339 |
| 3,927,705 | 12/1975 | Cromeens et al. | 144/3 R |

FOREIGN PATENT DOCUMENTS

| | | | |
|---|---|---|---|
| 241094 | 11/1964 | Austria | 144/309 L |
| 1453268 | 10/1969 | Fed. Rep. of Germany | 144/85 |

*Primary Examiner*—Othell M. Simpson
*Assistant Examiner*—W. D. Bray
*Attorney, Agent, or Firm*—Watson, Cole, Grindle & Watson

[57] ABSTRACT

An apparatus for processing short lengthed, elongate waste timber workpieces to usable timber beams of relatively long length includes a cutter device for cutting wedge-shaped tenons into the ends of the elongate workpieces, a gluing device for applying a thin coating of glue to the cut tenons on each end of each workpiece, and a press device for pressing the workpieces together such that the cut tenon ends of each workpiece is glued to the cut tenon ends of another workpiece to form a timber beam. A length-cutting device can be used to cut the timber beam into the appropriate lengths as desired.

20 Claims, 8 Drawing Figures

APPARATUS FOR PROCESSING WORKPIECES IN THE FORM OF SHORT-LENGTH ELONGATE TIMBER WASTE INTO USABLE TIMBER

This invention relates to apparatus for processing workpieces in the form of short-length elongate timber waste into usable timber, such for example as strips or beams, and of the kind comprising a toothed tenon cutting, milling or sawing device, a gluing device and a press device. The invention also relates to a process of producing usable timber.

Due to a scarcity of raw materials and a consequent increase in cost, even of timber, woodworking industries are obliged to recycle waste timber in the form of elongate waste, to form, for example strips or beams.

An object of the present invention is to provide apparatus of the kind aforesaid, which can be produced much more cheaply than known apparatus of a comparable kind, and which also enables small and medium-sized firms economically to reprocess or process timber waste in the form of elongate offcuts.

SUMMARY OF THE INVENTION

Provision is made according to the present invention for the tenon cutting device, upon which for example the workpieces are processed in pairs, to have at least two adjacently-located cutters, in front of which a table is movable to-and-fro in the cutting direction, said table being fed, preferably manually, in both end-positions with workpieces, the gluing device being provided with at least one comb, whose teeth, wettable with glue, are engageable in the tenons, for example wedge-shaped tenons, in the workpiece, and which is movable longitudinally along said tenons, and the press device having at least one table, movable for example by means of a fluid-operated ram, and at least one stationary table, the workpiece to be glued together being clampable on said tables.

The result is a relatively economical and uncomplicated apparatus for processing such timber waste. It is also possible for medium and small firms to make profitable use of said plant, manufacturing usable timber in the form for example of strips or beams from collected elongate timber waste. The apparatus needs only a small amount of space, and energy and installation costs are low, although the apparatus, because of its economy in use, has a high installation value. In addition, the apparatus is simple to use, and may be operated by only one man. The timber wste combined into usable timber by this plant has a high combined strength, roughly in the region of 80% of the strength of timber. The apparatus is not only suitable for combining such timber waste; but improvement in the quality of knotty timbers may also be achieved thereby, in that the knotty sections can be removed from such timber, and the knot-free timber sections can be re-combined by tenon joints by means of the apparatus. Such re-combined usable timber may be used for example as window timbers, or profiled strips. The apparatus with at least two tenon cutters and with at least one comb, can be fed in both end-positions of the moveable table with workpieces, and has a high operating speed, which may be controlled on the one hand by one single operative, and on the other hand ensures its economical operation. An advantage of the new arrangement consists in that per each double-stroke of the machine there can be machined two workpieces of different lengths on both ends thereof. The joints may be designed in various ways. In a preferred embodiment of the invention, wedge-shaped tenons are used, which are preferably about 7.4 mm in depth. The gluing device is also simple in design, and ensures a uniformly thin film on the surfaces of the wedge-shaped tenons on the timber sections. The adhesive film is applied very thinly, and this is of particular advantage in the subsequent pressing together of the timber sections, as lower pressures can be used. Therefore, the function of the combs consists in to determine the thickness of the glue layer as exactly as possible. Since the combs can be adjusted with respect to the gluing cylinder up to the smallest possible distance thereof, the thickness of the glue layer can most exactly be established.

Further automation and simplification in operating the apparatus results from the design of the press device, especially when it has a length-cutting device, by means of which the usable timber, which may be combined in an endless fashion, is cut into lengths, a further advantage arising when the length-cutting device has an adjustable stop.

DESCRIPTION OF THE DRAWINGS

An embodiment of the invention will now be described, by way of example, with reference to the accompanying diagrammatic drawings, in which.

DESCRIPTION OF THE PREFERRED EMBODIMENT

Figure 1:
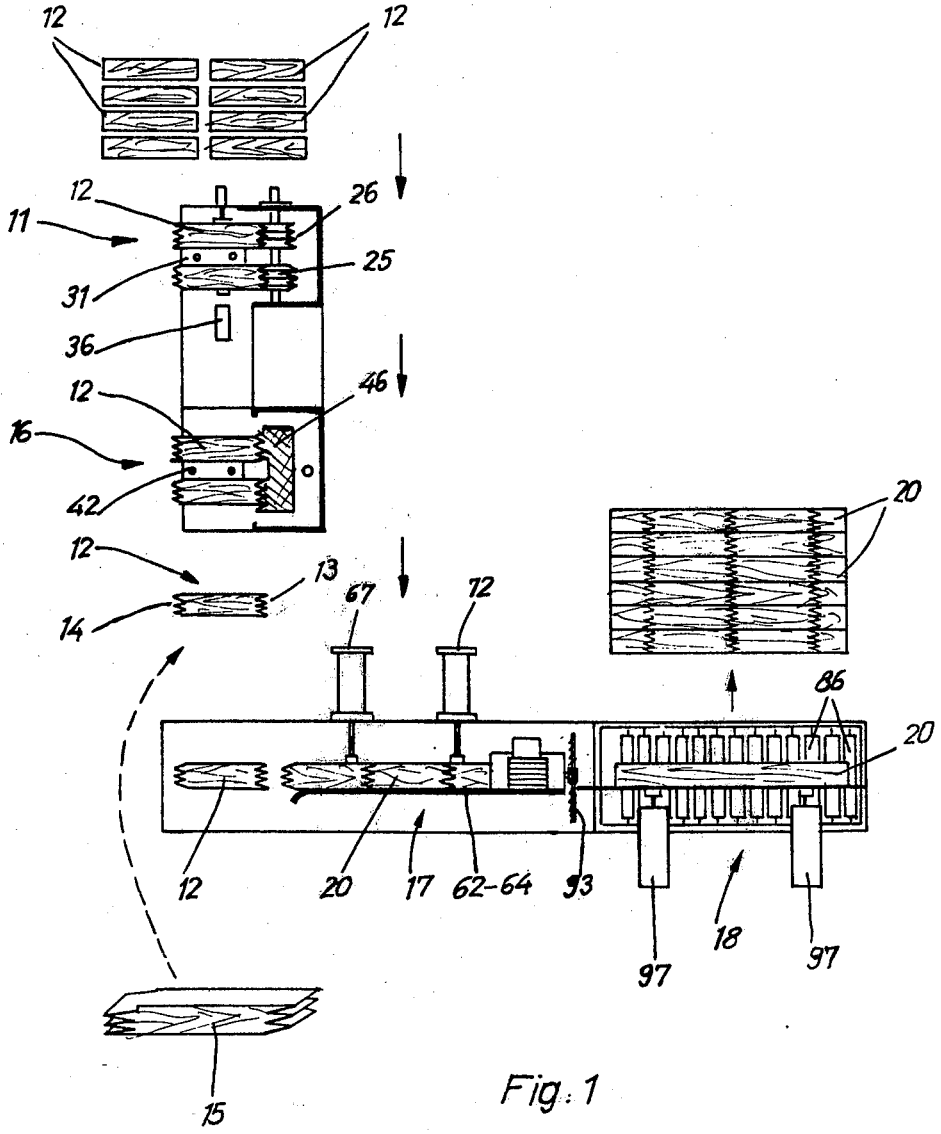
FIG. 1 is a plan schematic view of apparatus according to the present invention for the production of relatively long strips or beams from timber waste in the form of elongate offcuts of relatively short lengths.

As is apparent from FIG. 1, in the embodiment shown the apparatus for processing elongate timber waste, i.e., timber sections of short length, into strips or beams, comprises a cutting device 11, by means of which the end faces of waste timber 12 have cut in them wedge-shaped tenons 13, 14; a gluing device 16 for gluing the tenons 13, 14 of the timber sections 12; a press device 17, by means of which the tenons 13, 14 of two adjacent waste sections 12 are pressed into each other, and thus adhesively secured together; and a length-cutting device 18, by means of which the composite strips or beams can be cut to the desired length. By means of the apparatus, usable timber 20, for example in the form of strips or beams, can be produced in practically any length. The usable timber 20 is usable for example for window timbers, or profiled strips. In the embodiment shown, the apparatus consists of two machine units, the cutter device 11 and gluing device 16 being combined into a first machine unit, and the pressing device 17 and length-cutting device 18 being combined into a second machine unit. In this case, the cutter device 11 and the gluing device 16 are located parallel to each other, while the length-cutting device 18 is located behind the press device 17. Between the first and second machine units, a conveyor device (not shown) may be provided, which transports the waste sections 12, provided with the tenons 13, 14 and a coating of glue, from the gluing device 16 to the press device 17. The apparatus is designed for one-man operation, representing in an economical fashion a combination of automatic and manual operation.

Figure 2:
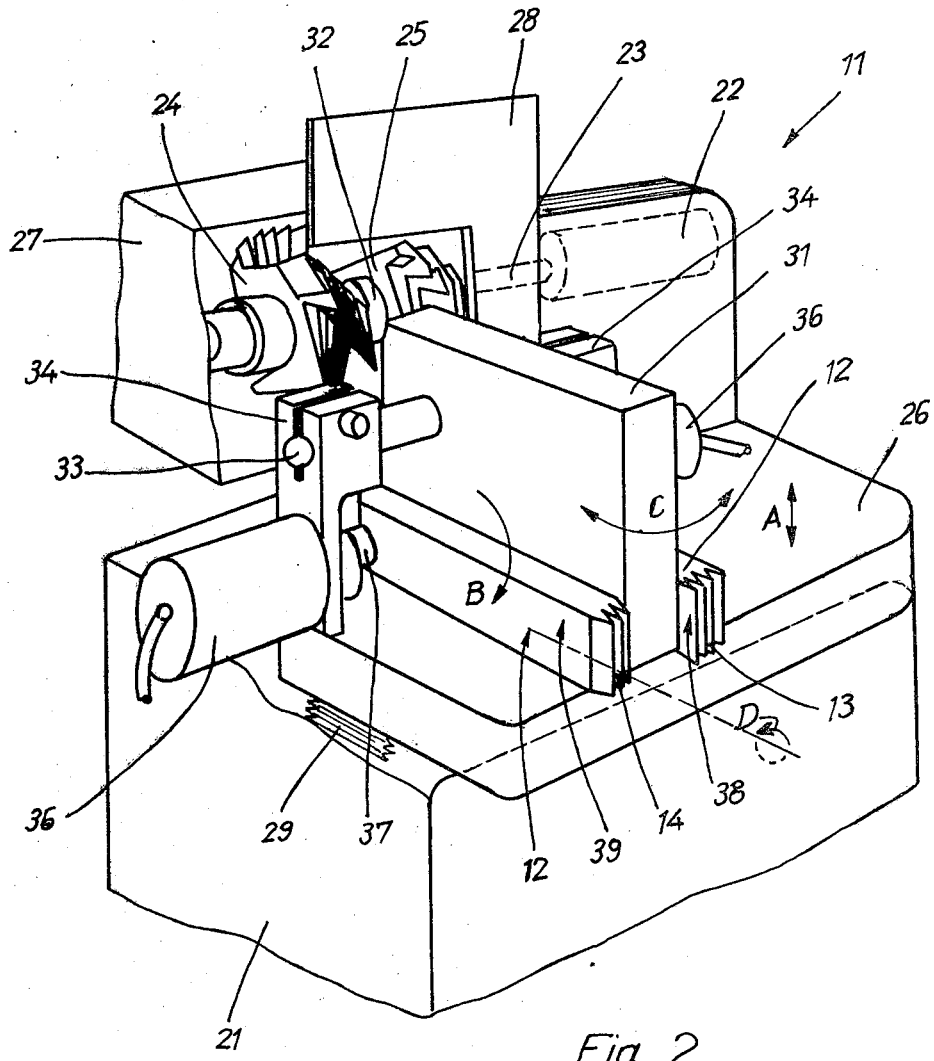
FIG. 2 is a perspective view of a tenon cutting device, to a larger scale.
Figure 3:
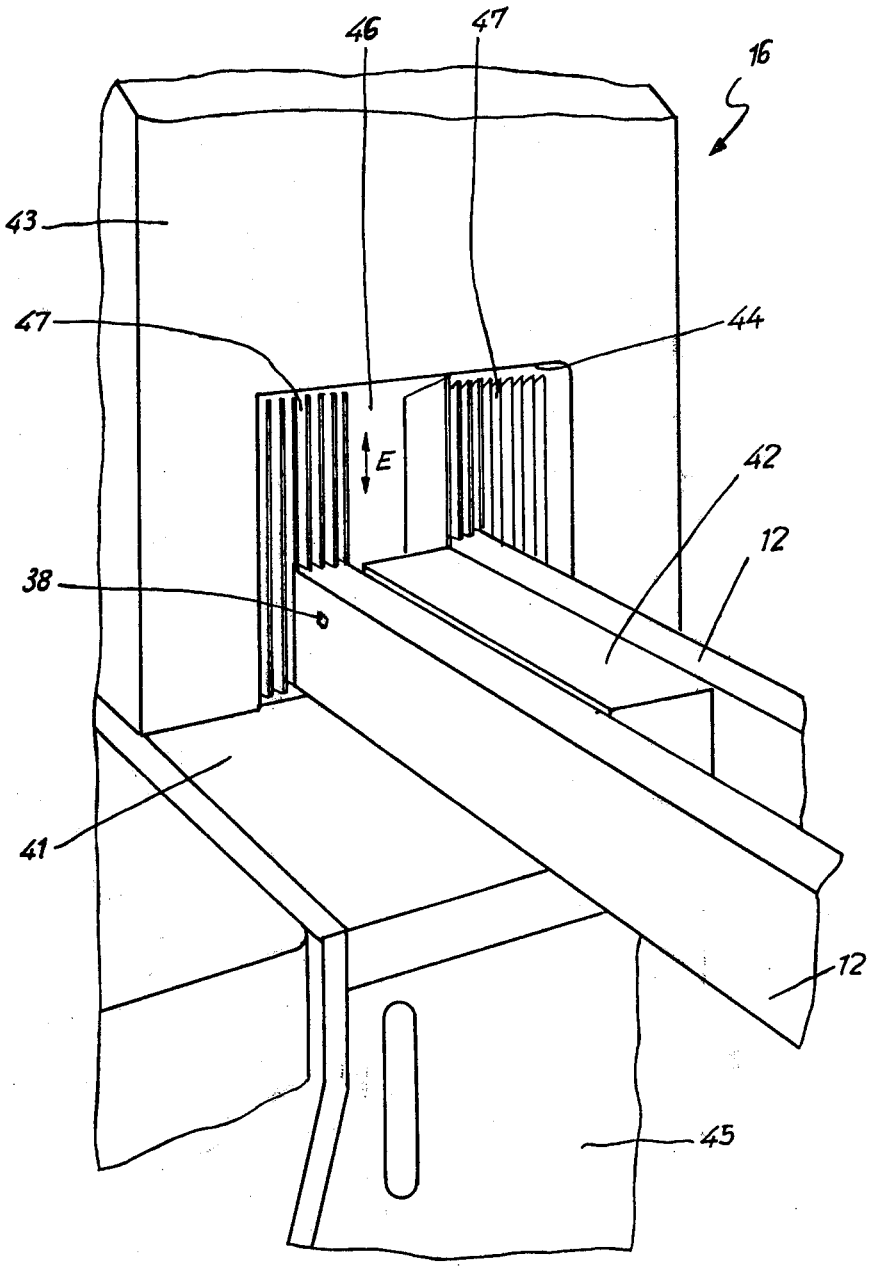
FIG. 3 is a perspective view of a joint-gluing device, to a larger scale.

The cutter device 11 shown in FIG. 2 has a machine stand 21, in the region of one of whose sides there is attached a drive motor 22, driving a shaft 23, on which there are mounted together, with an intervening space, two rotary cutters 24 and 25, driven simultaneously and at the same rotary speed. The cutters 24, 25 are located in a casing 27 opening towards a machine table 26, and are partially covered at their top end by a protective plate 28. The machine table 26 is movable to- and-fro according to double arrow A relative to the machine stand 21, the drive for this to-and-fro movement being effected hydraulically or pneumatically. A bellows 29 is located between machine table 26 and machine stand 21, affording protection against penetrating wood chips or the like. On the machine table 26, there is attached an abutment plate 31, projecting upwards from the machine table, and spanning its width, the plate 31 extending roughly parallel to the sides of machine table 26, and being attached at the region of machine table 26 lying opposite a spacer sleeve 42 on the shaft 23, the spacer sleeve 32 keeping both the cutters 24 and 25 at a constant distance apart. The plate 31 is thus located precisely between the two cutters 24, 25 and can, if necessary, be located so as to project between the cutters. In an area adjacent to the corner facing the cutters, the plate 31 is provided with a through-hole, through which a circular pin 33 is passed and immovably and non-rotatably secured in such a way that it projects on both sides uniformly from the side faces of the abutment plate 31. To each end of the round pin 33 there is attached a clamp 34, on whose end portion projecting towards the machine table 26, a pneumatic ram is flanged-on in each case, in such a way that its piston rod 37 is movable in the direction of the plate 34. The spacing of the clamps 34 from plate 31 is adjustable on the pin 33. In order to cut the wedge-shaped tenons 13, 14 in the end faces of the waste timber sections 12, a timber section 12 is located by an operator on both sides of the plate 31, against the relevant outer surface of the plate 31. The end faces of the waste sections 12 project beyond the end face of the plate 31 facing the cutters 24, 25, far enough for the tenons 13, 14 of corresponding depth to be cut. When the two waste timber sections 12 are properly located, the pneumatic rams 36 are actuated, so that the piston rods 37 press the waste timber sections 12 against the relevant side face of the plate 31. During this procedure, the waste sections 12 receive on their side faces by means of a stamp provided at the ends of the piston rods 37, a marking at 38 or 39, which indicates whether the end face of the waste section 12 has been provided with wedge-shaped tenons 13 or with wedge-shaped tenons 14. Contarary to FIG. 2, this first procedure is effected in a position of machine table 26 in which the latter is located above the cutters 24, 25. For the cutting procedure in which the cutter 24 cuts the tenons 13 relevant to marking 38, and the cutter 25 cuts the tenons 14 with marking 29, in the waste sections 12, the machine table 26 is moved downwards toward machine stand 21. Then, both waste sections 12 are rotated in the direction of arrow B through 180° and, according to double arrow C, moved from one outer side to the other of the plate 31, the pneumatic rams 36 being correspondingly actuated. During the upward movement of the machine table 26 in the direction of the arrow A, the other end faces of the waste sections 12 are then provided with tenons 13, 14 of the other type in each case. Each waste section 12 thus has on its end face wedge tenons 13 and on its other end face wedge tenons 14. Thus, by means of an upward and downward movement according to double arrow A, the relevant tenons are cut in two waste timber sections 12 on both end faces.

In the embodiment shown, the wedge-shaped tenons 13, 14 on the waste timber sections 12 are respectively symmetrical about the longitudinal medial plane, as is particularly apparent in FIG. 1. The tenons 13 are located on the end face of waste section 12 in such a way that their outermost face of a tenon on both sides is in each case flush with the side face of the timber section 12, while the tenons 14 are located on the end face of the section 12 in such a way that the relevant outermost faces extend in a wedge shape relative to the relevant side faces of the section 12. In this embodiment, therefore, the cutters 24 and 25 are respectively offset to each other relative to the relevant outer face of the plate 31, so that the corresponding differing arrangement of the tenons results on the end faces of the sections 12. It is, however, also possible to rotate the sections 12 only in the direction of arrow B through 180° before the upward movement, thus not also changing them according to double arrow C, so that then two different waste sections 12 result, of which one is provided on both ends with tenons 13, and the other on both ends with tenons 14. Finally, it is also possible to locate the cutters 24 and 25 on the shaft 23 in such a way that the tenons, as indicated in FIG. 1 on a timber section 15, are asymmetrically located on the end faces of the section 15. In this embodiment, before the upward movement of the machine table 26, the timber sections 15 are not only rotated according to the arrow B around the transverse axis, but are also turned through 180° according to the arrow D in dotted lines in FIG. 2, the exchange according to the double arrow C not taking place.

The waste timber sections provided in this way with the wedge tenons 13, 14, are fed to the gluing device 16. The latter has a table 41, likewise provided with an abutment plate 42, against which the timber sections 12 are applied by their side faces. In front of the table 41 is a casing 43 with a rectangular opening 44 facing in the direction of table 41 or of the plate 42. Within the casing 43, a comb device 46 is located and guided to move up and down according to double arrow E. The comb device 46 has two combs 47, located at a spacing corresponding to the width of the plate 42, and whose teeth can engage between the wedge tenons 13, 14. The waste sections 12 are so located on table 41 that the teeth of combs 47 and the wedge tenons 13, 14 engage in one another. Beneath the table 41 in a casing 45, there is a glue supply container 48, two nozzles 49 connected thereto, and a stripper comb 51.

Figure 4:
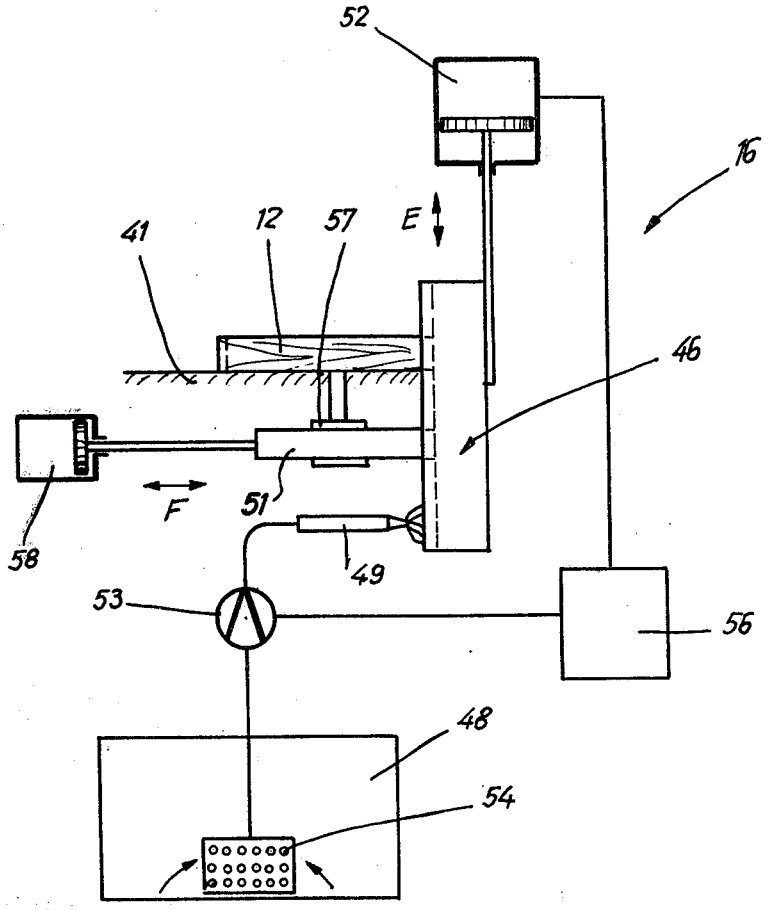
FIG. 4 is a diagrammatic plan view showing the gluing process.

According to FIG. 4, the comb device 46 is movable up and down by means of a pneumatic ram 52 according to double arrow E. The extent of the upward and downward movement of the comb device 46 is such that the two nozzles, each lying opposite one of the combs 47, can cover the entire height of the comb device 46. The two nozzles 49 are connected to the supply container 48 by a conveyor device 53 in order to spray the combs 47 with glue. Located in the supply container 48, is a screen 54, through which glue is fed to the nozzles 49. The conveyor device 53 is switched on and off by a control device 56, also connected to the pneumatic ram 52. Between the table 41 and the nozzles 49 located thereunder is the stripper comb 51, which is movable according to double arrow F to-and-fro in the direction of the comb device 46 in a guide 57 attached to the table 41; the comb device serving, during the upward movement, to leave only a thin film of glue on the surface of the combs 47, while the stripped-off superfluous glue is returned to the supply container 48 by means of a device, not shown. The thin glue film is applied during the upward movement of the comb device 46 to the surface of the tenons 13, 14 of the timber sections 12. While the timber sections 12 are rotated through 180° in order to glue their other end faces, the comb device 46 moves downward past nozzles 49, so that during the next upward stroke the following gluing process can be carried out. It is obvious that the pneumatic ram 58 for stripper comb 51 is controlled in a corresponding manner. By means of the stripper comb 51, which is movable at a predetermined spacing in front of the comb device 46, the required amount of glue can be very accurately measured. This provision of a very thin film of glue has the advantage that only a thin film of glue is also applied to the surface of the tenons 13, 14 of the sections 12, so that, during the pressing procedure, no superfluous glue is pressed out of the joint, so that during this process smaller forces can be used than heretofore. During gluing, the timber sections 12 can be held by hand.

When all the tenons 13, 14 of both sections 12 have been coated with glue, they are then arranged in accordance with their markings 38, 39 and are conveyed to the press device 17, either by hand or by a conveyor device, not shown.

Figure 5:
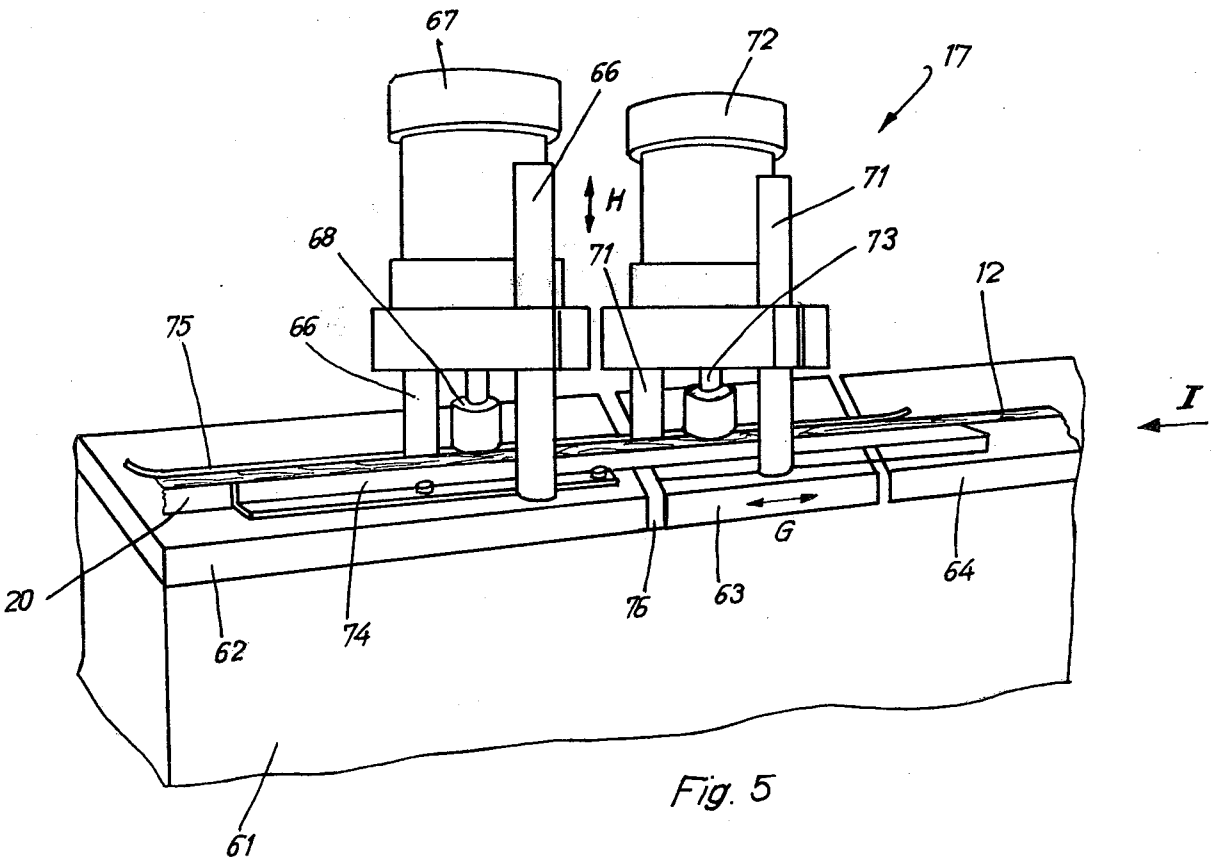
FIG. 5 is a perspective view of a press device, to a larger scale.

According to FIG. 5, the press device 17 has a stand 61, on which a table section 63 is guided so as to be movable to-and-fro according to the double arrow G, between two fixed tables sections 62 and 64. On the fixed table section 62, there are attached two parallel guide rods 66, projecting vertically upwards, on which a pneumatic pressure ram 66 is vertically adjustably attached, whose piston rod 68 is movable up and down in the direction of the double arrow H. On the movable table section 63, there are also attached two upwardly-projecting parallel guide rods 71, on which a second pneumatic ram 72 is vertically adjustably attached, whose piston rod 73 is likewise movable up and down according to the double arrow H. Along the table sections 62, 63 and 64, there extends a guide fence 74 and parallel thereto a guide rail 75, the fence 74 and the rail 75 being attached to the fixed table section 62, and extending at a small distance above the surface of the movable table section 63, and on the fixed table section 64. At their ends, the guide fence 74 and the rail 75 are slightly bent outwards in order to form an insertion opening.

Figure 6A:
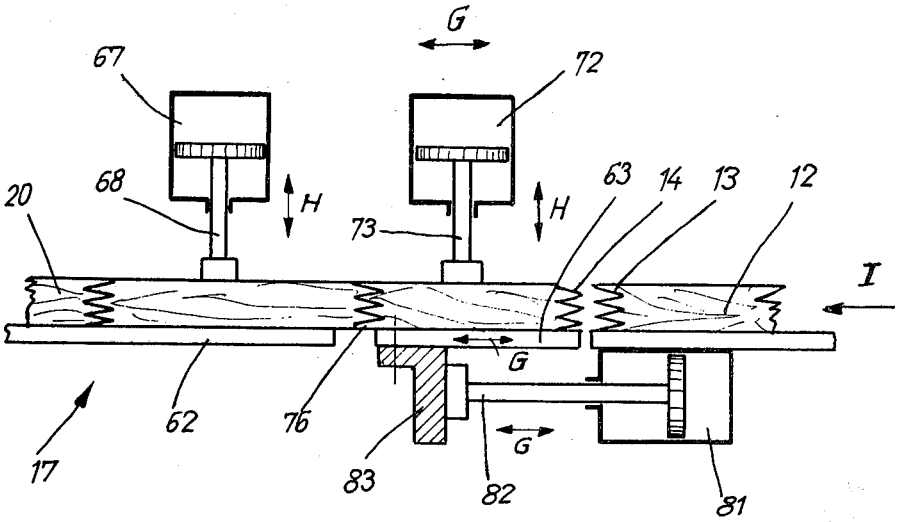
FIGS. 6*a* and 6*b* are respectively a longitudinal section through the press device according to FIG. 5, and a plan view of the guide device for the press device according to FIG. 5.
Figure 6B:
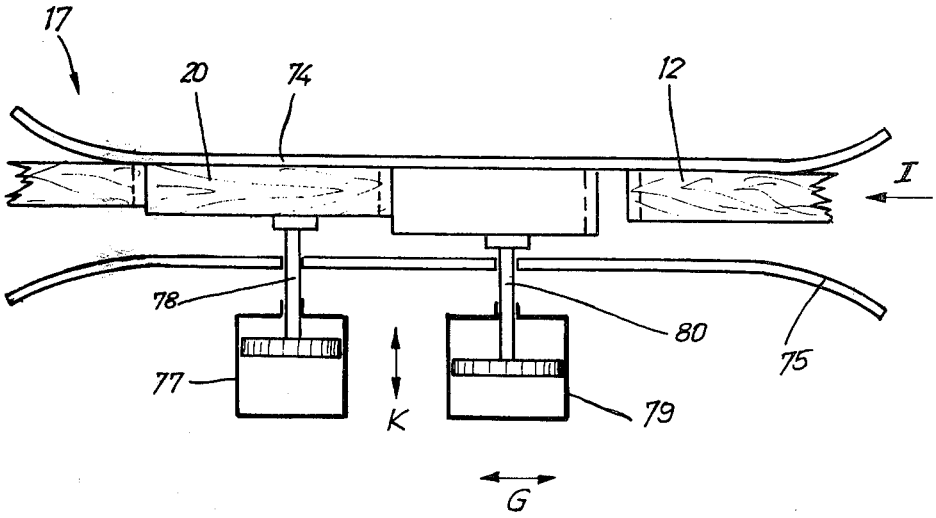

The operation of the press device 17 is further explained with reference to FIGS. 6*a* and 6*b*. The timber sections 12 are introduced in the direction of arrow I between the guide fence 74 and the guide rail 75. These pieces may be transported between the fence 74 and the rail 75 by hand, or by means of a conveyor device, not shown. One timber section is inserted into the press 17 until it is located under the first, fixed pressure ram 67, and its end provided with wedge tenons 13 or 14 is located above a slot 76 between the fixed table section 62 and the movable table section 63. By means of a first, fixed pneumatic ram 77, whose piston rod 78 passes through the guide rail 75, this timber section is pressed against the guide fence 74. Thereupon, the relevant timber section is pressed by the ram 67 against the table surface, and is immovably held there. A second timber section 12 is then fed in, until its wedge tenons 14 or 13 engage lightly in the wedge tenons 13 or 14 of the adjacent timber 12. At this stage, the second timber 12 is pressed by a second pneumatic ram 79, whose piston rod 80, like the piston rod 78 of the first pneumatic ram 77, is movable to-and fro according to double arrow K, and passes through the guide rail 74, towards the guide fence 74, so that both waste timber sections 12, if they are of differing widths, are at least flush on one side surface. This second section 12 is then pressed by the second pneumatic ram 72 against the surface of the movable table section 63, so that it is immovably held thereupon. Then, the movable table section 63 is moved in the direction of the fixed table section 62, this being effected with the aid of a pneumatic ram 81, secured to the fixed table section 64, and whose piston rod 82 presses against an angle piece 83 fixed on the movable table section 63. The pressure generated by the pneumatic ram 81 causes both adjacent timber sections 12 to be connected securely together by means of the glue. It is preferable that a rapid drying glue is used. Once this glue connection is produced, the rams 67 and 72 are retracted, so that the two glued-together timber sections 12 can be moved along in the direction of arrow I. At this stage, the pressure ram 81 is also retracted. The two connected timber sections are moved until the rear section 12 in the direction of movement comes to rest under the first fixed pressure ram 67. A third timber section 12 is then pushed in until it lies beneath the second pressure ram 72, movable along with the movable table section 63. Gluing of this timber section 12 with the timber section 12 lying before it in the direction of movement is effected in the same way. Thus, usable timber sections 12 of practically endless length can be produced from a plurality of waste timber sections 12. It should be noted that in the embodiment shown, the two pressure rams 77, 79 are retracted when the pressure rams 67, 72 are pressing the timbers 12 against the table sections.

Figure 7:
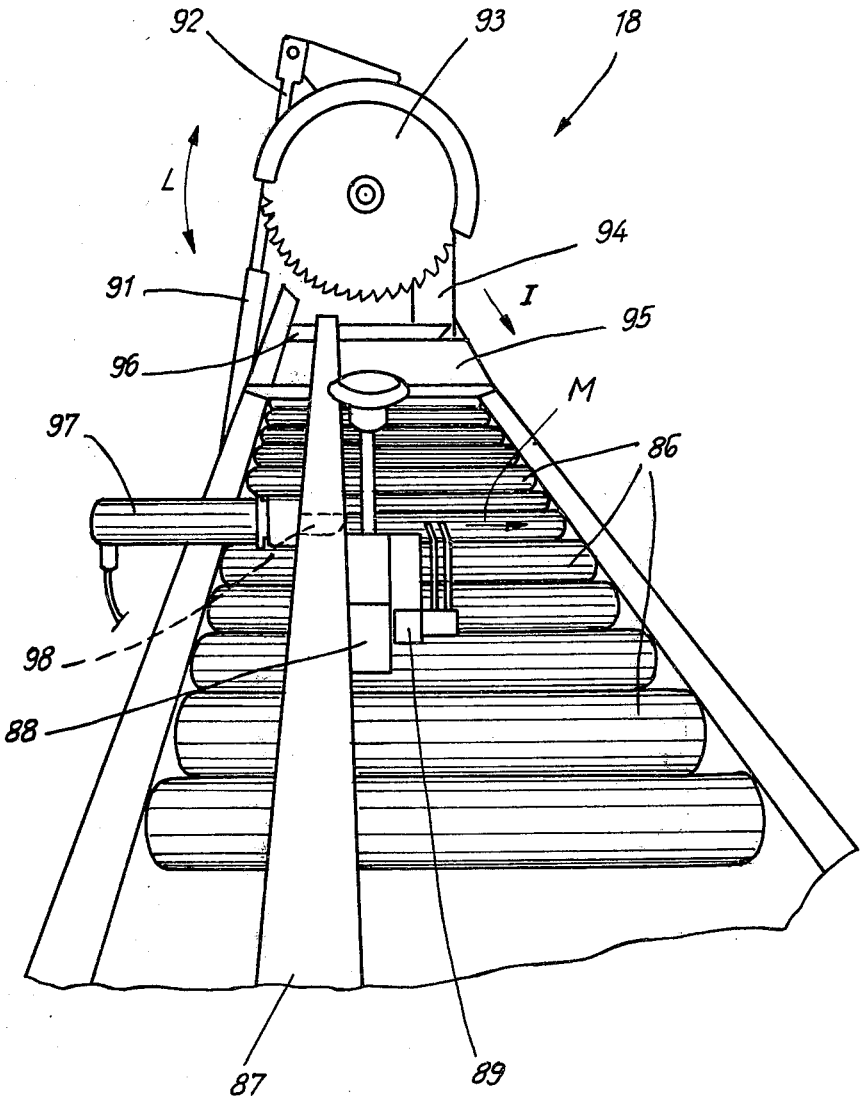
FIG. 7 is a perspective view of a length-cutting device to a larger scale.

Following the press device 17 in the direction of arrow I, FIG. 5, there is the length-cutting device 18, whose support surface lies in the same plane as the surface of the table sections 62 and 64. The guide surface of the length-cutting device 18 consists of a plurality of successive parallel cylindrical rollers 86, FIG. 7, of which at least one is driven, in order to generate a feed movement for the usable timber 20 glued together from the waste timber sections 12. Located above the rollers 86 there is a guide fence 87 extending longitudinally of the length-cutting device 18, and which forms an extension of the guide fence 74 of the press device 17. A movable stop 88, is guided along the guide fence 87, the stop 88 being provided with an end switch 89, which is connected in a controlling manner to a pneumatic ram 91, whose piston rod 92 is connected to a circular saw 93, which is pivotal upwards and downwards in the direction of double arrow L on a gallows-like support 94 rigidly connected to the length-cutting dvice 18. When a timber section 20 is fed to the length-cutting device 18, and abuts with its end against end switch 89 of the movable stop 88, the circular saw 93 is pivoted downwards and cuts through said timber. An end stop not shown ensures that the circular saw 93, after cutting the usable timber, is again pivoted upwards. The circular saw 93 is located above a region of the table 95, which lies in the feed direction I in advance of the cylindrical rollers 76 and is provided with a saw slot 96. After length-cutting, one or two pneumatic ejector rams 97 is or are actuated, whose piston rod 98 presses against the relevant timber section 20 and ejects it or moves it far enough in the direction of arrow M for its end to be moved past the movable stop 88.

In the embodiment shown, in addition to the piston-cylinder unit or ram for moving the machine table 26 up and down relative to the cutter device 11, which can be hydraulically operated, all such units can be pneumatic units, which has the advantage that the apparatus is relatively economical.

Instead of the glue mentioned above, any other adhesive may be used to join the wedge-shaped tenons of the timber sections. The cutters and combs of the comb device are selected to correspond to the thickness of the maximum size of timber section to be processed. As also relatively narrow timber sections may be processed with the same plant, it can be advantageous if the gluing device has several glue nozzles per comb, distributed across the width of each comb, which can be switched on or off in accordance with the thickness of the timber sections to be processed. The height of the combs also is at least equal to the maximum tenon length of the timber sections to be processed. The apparatus may also be provided with several pairs of cutters and combs, so that several pairs of timber sections may be simultaneously processed in the cutter device 11 and in the gluing device 16. In the embodiment shown, workpieces with a width between about 15 and 125 mm, and with a thickness between about 8 and 70 mm and a minimum length of 200 mm may be processed. Dependent upon the length of the workpiece, working speeds of about 5 to 6 workpieces per minute are achievable.

Further, according to the embodiment shown, wedge tenons are cut about 7.5 mm deep, and it is clear that other types of tenons can be cut or sawn.

Although my invention has been illustrated and described with reference to the preferred embodiments thereof, I wish to have it understood that it is in no way limited to the details of such embodiments, but is capable of numerous modifications within the scope of the appended claims.

Having thus fully disclosed my invention, what I claim is:

1. An apparatus for processing short lengthed, elongate waste timber workpieces into usable timber beams of relatively long length which comprises (1) a cutter means for cutting tenons into each of the elongate ends of each of the waste timber workpieces, said cutter means comprising a vertically movable machine table, an abutment plate mounted on said machine table and extending upwardly away therefrom, and two spaced apart cutter blades mounted on a common shaft and positioned adjacent to said abutment plate, such that when two waste timber workpieces are placed, respectively, at the intersection point between said machine table and one side surface of said abutment plate and the intersection point between said machine table and the other side surface of said abutment plate, and said machine table moved vertically, said two cutter blades may respectively cut tenons into the adjacent ends of the two workpieces;

(2) a gluing means positioned adjacent to said cutter means for supplying a thin film of glue to the cut tenons on each end of each of the waste timber workpieces cut by said cutter means; and (3) a press means positioned adjacent to said gluing means for progressively pressing the glue-coated cut tenons of each end of each of the waste timber workpieces treated by said gluing means into a glue-coated cut tenon of another waste timber workpiece so as to allow gluing of the workpieces together to form a timber beam of relatively long length.

2. The apparatus of claim 1, wherein said cutter means includes a drive motor for rotating the shaft on which the two cutter blades are mounted.

3. The apparatus of claim 2, wherein said cutter means includes separate means for retaining each of the two workpieces in the respective intersection points between said machine table and said abutment plate during the tenon-cutting operation.

4. The apparatus of claim 3, wherein the rotatable shaft on which said cutter blades are mounted is positioned in horizontal fashion.

5. The apparatus of claim 4, wherein said machine table is horizontally mounted on a machine stand and wherein said machine table is movable in a horizontal direction.

6. The apparatus of claim 5, wherein the cutter blades mounted on the shaft are spaced apart by a spacer sleeve a distance equal to the thickness of the abutment plate between the side surfaces thereof.

7. The apparatus of claim 6, wherein each of said separate means for retaining each of the two workpieces in the respective intersection points between said machine table and said abutment plate comprise a fluid-operated ram which includes a piston rod positionable against the workpiece to retain it in place.

8. The apparatus of claim 6, wherein each side surface of the abutment plate includes a pin extending horizontally away therefrom, wherein each fluid-operated ram includes a clamp means, and wherein each clamp means is adjustable positionable around each pin so as to adjust the distance of each ram from the respective side surface of said abutment plate.

9. The apparatus of claim 1, wherein said gluing means includes a horizontally disposed table upon which the waste timber workpieces may be placed, and a comb device mounted at one edge of the table and vertically movable with respect thereto, said comb device including two spaced apart combs on which a thin layer of glue is capable of being placed.

10. The apparatus of claim 9, wherein said horizontally disposed table includes an abutment block mounted thereon and extending vertically away therefrom, wherein said abutment block has first and second vertical sides against which two waste timber workpieces may be respectively placed, and wherein said two combs on said comb device are spaced apart a distance equal to the thickness of said abutment block between the first and second vertical sides thereof.

11. The apparatus of claim 10, wherein means are provided to move said comb device vertically.

12. The apparatus of claim 10, wherein said gluing means includes a glue-supply container, nozzles positioned beneath said horizontally disposed table to discharge glue against each of said separate combs, means for conveying glue from said glue-supply container to said nozzles, and means positioned adjacent said combs and between said horizontally disposed table and said nozzles to control the thickness of glue on said combs as said comb device is moved in a vertical direction.

13. The apparatus of claim 1, wherein said press means includes a fixed table on which a waste timber workpiece may be placed and a movable table which may be moved towards and away from said fixed table and on which a different waste timber workpiece may be placed, a guide fence positioned on said fixed table and extending over said movable table and against which the workpieces may be pressed, and first and second rams mounted respectively on said fixed table and said movable table for pressing the respective workpieces against said guide fence.

14. The apparatus of claim 13 wherein said press means includes means for moving said movable table towards said fixed table so as to interconnect the glue-coated cut tenon end of one waste timber workpiece mounted thereon with a glue-coated tenon end of another waste timber workpiece mounted on said fixed table to form a timber beam of combined waste timber workpieces.

15. The apparatus of claim 14, wherein said press means includes third and fourth rams mounted respectively on said fixed table and said movable table for pressing the respective workpieces against the table on which they are placed.

16. The apparatus of claim 1, wherein a length-cutting means is positioned adjacent to said press means for cutting to length the timber beam produced by said press means to form multiple timber beams of predetermined length.

17. The apparatus of claim 16, wherein said length-cutting means includes a circular saw, a support surface, means for pivoting the circular saw towards the support surface, and an end switch for operating the circular saw.

18. The apparatus of claim 17, wherein said support surface includes a multiplicity of parallel rollers upon which the timber beam from the pressing means may be fed.

19. The apparatus of claim 18 wherein said length-cutting means includes means for displacing the cut timber beams, once cut to length, from said support surface.

20. A method for processing short lengthed, elongate waste timber workpieces into usable timber beams of relatively long length which comprises (a) placing waste timber workpieces in pairs on a movable table of a tenon-cutting machine;
(b) clamping the workpieces in place on said movable table;
(c) cutting tenons in one of the ends of each of the pair of timber workpieces;
(d) rotating the pair of timber workpieces on the movable table;
(e) cutting tenons in the other of the ends of each of the pair of timber workpieces;
(f) placing the pair of cut timber workpieces on the fixed table of a gluing device such that one of the ends of each of the pair of workpieces is placed against a glue-coated comb;
(g) moving the combs past said pair of workpieces to apply a thin coating of glue on said contacting tenon-cut ends;
(h) rotating said pair of workpieces on said fixed table so that the other of the ends of each of the pair of timber workpieces is placed against a glue-coated comb;
(i) moving the combs past said pair of workpieces to apply a thin coating of glue on said contacting tenon-cut ends;
(j) pressing together the glue-coated tenon-cut ends of said pair of workpieces to form a timber beam;
(k) sequentially pressing a further glue-coated tenon-cut end of additional waste timber workpiece to an exposed glue-coated tenon-cut end of the timber beam of (j) to produce a longer timber beam; and
(l) cutting the longer timber beam of (k) to the desired length using a cutting device.

* * * * *